United States Patent [19]

Arikawa et al.

[11] Patent Number: 4,599,596

[45] Date of Patent: Jul. 8, 1986

[54] CHIP TYPE FUSE

[75] Inventors: Hiroo Arikawa, Tokyo; Yasutada Yuza, Yokohama, both of Japan

[73] Assignee: S.O.C. Corporation, Tokyo, Japan

[21] Appl. No.: 556,011

[22] Filed: Nov. 29, 1983

[30] Foreign Application Priority Data

Dec. 1, 1982 [JP] Japan ..... 57-180640[U]

[51] Int. Cl.[4] ..... H01H 85/02; H01H 85/16

[52] U.S. Cl. ..... 337/201; 337/251; 337/260

[58] Field of Search ..... 337/186, 191, 260, 255, 337/187, 190, 201, 227, 228, 232, 236, 237, 248, 251, 252, 253; 174/52 R

[56] References Cited

U.S. PATENT DOCUMENTS

| | | | |
|---|---|---|---|
| 1,033,123 | 7/1912 | Schweitzer et al. | 337/186 |
| 3,037,070 | 5/1962 | Sussman et al. | 174/52 R |
| 3,110,787 | 12/1963 | Borzoni | 337/260 |
| 4,349,805 | 9/1982 | Arikawa | 337/260 |
| 4,483,064 | 11/1984 | Bernstein | 337/186 |

*Primary Examiner*—Harold Broome

[57] ABSTRACT

A chip fuse comprises a fuse base and a cover therefor both made of a heat resistant and electrically insulating material. The fuse comprises a pair of electrically conductive terminals, each having one end exposed outside of said base for soldering to a printed circuit board, with the other ends of the conductive terminals being spaced apart and in opposed relation to one another inside the fuse base. A fusible element is stretched between the inner ends of said conductive terminals and is secured to said ends by soldering or other suitable means.

1 Claim, 7 Drawing Figures

CHIP TYPE FUSE

FIELD OF THE INVENTION

This invention relates to a chip type fuse and is particularly related to a fuse which, due to its small size, will also be referred to as "chip fuse". In one particular aspect, the present invention relates to a chip fuse which can be electrically connected to an electrical circuit such as a printed circuit board (PCB) without lead wires or a fuseholder.

BACKGROUND OF THE INVENTION

Conventional fuses are usually connected to an electric circuit by soldering the lead wires to the circuit or by mounting the fuse in a fuseholder. With increased and widespread use of miniaturized electric circuitries such as, e.g., PCB, there has developed increased interest in reducing the fuse size as much as practicable. The use of fuseholders or lead wires, however, contribute to increased fuse size, and hence, they detract from miniaturization of the fuse.

Recently, some fuses have been miniaturized to as small as 7 mm, which is approximately the size of electrical resistors with lead wires. However, these miniaturized fuses require lead wires and this contributes to the bulkiness of the fuse. Consequently, where more than one fuse must be used in the PCB, the increased overall fuse size limits the number of fuses which can be used in such circuitries.

While efforts have heretofore been made to miniaturize the electric fuses, these fuses still employ lead wires and fuseholders which limit the degree to which such miniaturization can be achieved.

Accordingly, it is an object of this invention to provide a miniature fuse uniquely suited for use in miniaturized electric circuitries.

It is a further object of this invention to provide a chip type fuse which, due to its unique construction, can be soldered directly to the PCB or the miniaturized electric circuit.

The foregoing and other objects, features and advantages of the present invention will be appreciated from the following detailed description and the accompanying drawings.

SUMMARY OF THE INVENTION

In accordance with the present invention, there is provided a chip fuse comprising a base and a cover for said base both made of a heat resistant and electrically insulating material. The fuse further comprises a pair of electrically conductive terminals, each terminal having one end exposed outside of said fuse base adapted to be soldered to an electric circuit board, with the other ends of said terminals being spaced apart and opposed to one another inside the fuse base. In one embodiment of the invention, the conductive terminals are in irregular generally H-shaped form with opposed faces inside the fuse base.

A fusible element is stretched between the inside ends of the conductive terminals and, in one embodiment, the fusible element is passed through a groove in said fuse base disposed between said ends of the conductive terminals.

The fuse cover is configured to tightly cover the base and securely engage said conductive terminals thereby hermetically sealing the fuse base. For example, a suitable adhesive may be used to seal the cover 3 to base 1 in order to insure airtight engagement between the base and the cover.

Other features and embodiments of the invention will be described in the ensuing detailed description.

BRIEF DESCRIPTION OF THE DRAWINGS

In the drawings, wherein like numerals are employed to designate like parts.

DETAILED DESCRIPTION OF THE INVENTION

Figure 1:
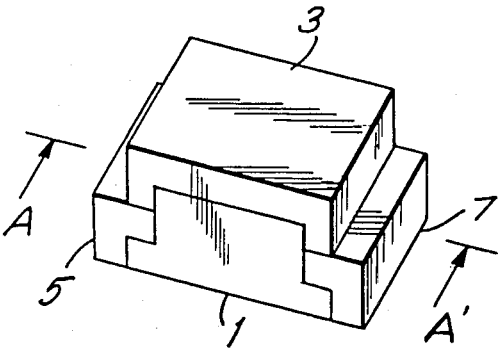
FIG. 1 is a perspective view of the chip fuse of the present invention.

Referring to FIG. 1, the chip fuse of the present invention comprises a fuse base 1 and a fuse cap or cover 3, both made of a heat resistant, electrically insulative material. The chip fuse also comprises electrically conductive terminals 5 and 7, the features and construction of which will be described in further detail.

Figure 7:
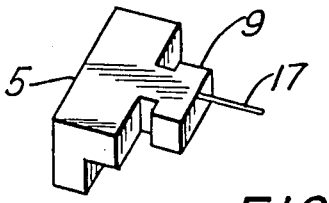
FIG. 7 is a perspective view of one of the conductive terminals of the fuse shown in FIGS. 1 and 2.

The conductive terminals 5 and 7 are both made in irregular, generally H-shaped form as shown in FIG. 7 which illustrates one of the terminals, i.e., conductive terminal 5. Each conductive terminal has a generally rectangular section *5a, 7a* which extends outside the fuse base 1 so that it can be soldered, welded or otherwise adhered to the PCB (not shown). The interior part of the conductive terminals 5 and 7 are formed into generally T-shaped parts 9 and 11 whose opposed T faces are spaced apart within the fuse base 1 as seen, for example, from FIG. 4. Each of the T-shaped sections of the conductive terminals is disposed within a similarly configured recess or cavity in the fuse base 1. These cavities are sized and configured so as to snap the T-shaped members therein in a secure and fixed position. If desired, the T-shaped members may be bonded or otherwise securely positioned in the fuse base.

Figure 4:
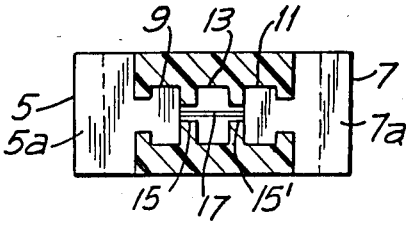
FIG. 4 is a plan view of the base of the chip fuse shown in FIGS. 1 and 2.

As shown further in drawings, e.g., in FIG. 4, the fuse base is also provided with a middle cavity 13 which communicates with a pair of grooves 15, 15' disposed on the sides of said cavity 13. A fusible element 17 is stretched across the middle cavity 13, through the grooves 15, 15' and its respective ends soldered, adhered or otherwise secured to the opposed T-shaped members of each conductive terminal. Thus, the middle cavity 13 and the laterally extending grooves 15, 15' define a generally cross-shaped cavity across which the fusible element 17 is stretched and secured as aforesaid.

As it was previously mentioned, each conductive terminal has a portion projecting laterally relative to the fuse base so that said terminals can be soldered to the PCB or other circuitry. Alternatively, each conductive terminal may be coterminous with the fuse base and has its bottom projecting below the fuse base for soldering to the electric circuitry.

Figure 2:
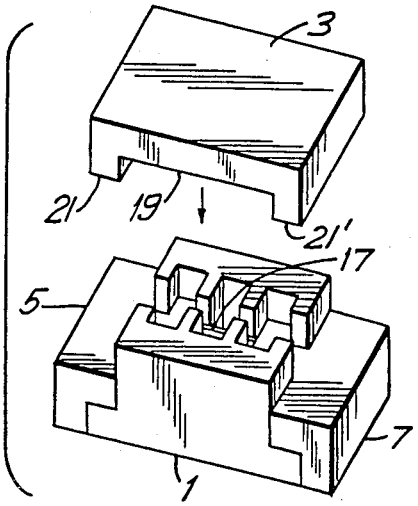
FIG. 2 is a perspective view of the chip fuse shown in FIG. 1 with the fuse cover removed.
Figure 3:
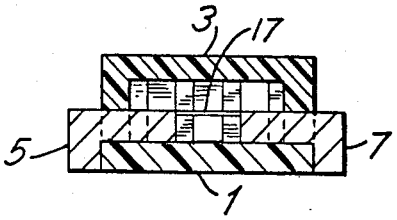
FIG. 3 is a sectional view taken along the line A—A' of FIG. 1.

As illustrated in FIGS. 1 and 2, the chip fuse of the present invention also comprises a cap or cover 3 which, preferably, has a recessed mid portion 19 and downwardly projecting lateral shoulders 21, 21'. The fuse cover 3 is sized and configured to be snapped into engagement with the fuse base in the direction of the arrow in FIG. 2, and when so snapped, the shoulder 21, 21' will press against the conductive terminals to further stabilize them against any movement or displacement. A suitable adhesive may be used to seal the cover 3 to base 1 in order to insure airtight engagement between the base and the cover.

As it can be appreciated from the foregoing description, the chip fuse of the invention does not require lead wires for connection to an electric circuit nor does it require a fuseholder. The fuse chip is simply placed in the circuit board and is soldered or otherwise suitably secured thereto. Direct soldering of the fuse to the PCB is also possible by immersing the fuse body in a hot solder bath. In any case, the chip fuse of this invention does not require piercing holes in the PCB, thus saving time and money which would otherwise be required.

Figure 5:
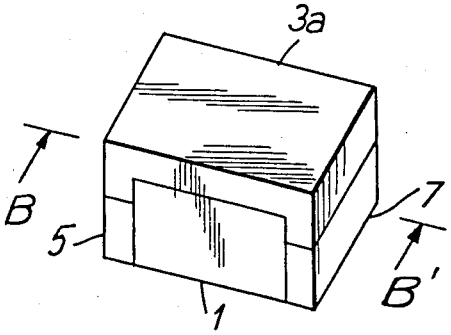
FIG. 5 is a perspective view of a different embodiment of the invention.
Figure 6:
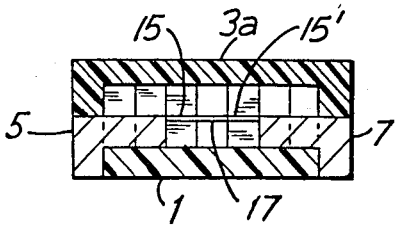
FIG. 6 is a sectional view taken along the line B—B' of FIG. 5.

It is evident from the description of the present invention that some changes and/or modifications may be made therein without departing from the scope thereof. For example, as shown in FIGS. 5 and 6, the fuse cap or cover 3*a* may be made wider so as to form an umbrella to cover the entire fuse base, including the laterally projecting ends of the conductive terminals shown in FIGS. 1 and 2. Otherwise, the construction of the chip fuse of FIGS. 5 and 6 is essentially the same as the chip fuse illustrated in FIGS. 1–4. Other changes and/or modifications are evident to those skilled in the art from the foregoing detailed description of the invention.

What is claimed is:

1. A chip type fuse for direct surface mounting to a printed circuit board, said fuse comprising:

(a) a base and a cover therefor, both made of heat-resistant and electrically insulating material, said base having a cavity formed substantially in the center thereof, (b) a pair of electrically conductive terminals at both ends of said base, the top plan view of each of said terminals having a generally H-shaped configuration, each of said terminals having a large portion, a small portion and a middle portion connecting said large and small portions so as to form said generally H-shaped configuration, wherein said terminals are snapped into said base so that the bottom of each of said large portions and small portions can be soldered directly to a printed board circuit, and wherein said small portions of said terminals are spaced apart and in facing relations to each other and positioned in said cavity, (c) a pair of grooves extending between each of said small portions of said terminals and through said cavity, (d) a fusible element stretched between said terminals and extending through said grooves and said cavity, the ends of said fusible elements being soldered to said conductive terminals, and (e) said cover being hermetically sealed to said base by an adhesive, thereby immovably fixing said two terminals in said base.

* * * * *